US006131775A

United States Patent [19]

Brody

[11] Patent Number: 6,131,775

[45] Date of Patent: Oct. 17, 2000

[54] SQUEEZE BOTTLE WITH LOCKABLE CLOSURE ASSEMBLY

[75] Inventor: Harvey Brody, Costa Mesa, Calif.

[73] Assignee: Norvey, Inc., Santa Ana, Calif.

[21] Appl. No.: 09/232,059

[22] Filed: Jan. 15, 1999

[51] Int. Cl.[7] ..... B65D 37/00

[52] U.S. Cl. ..... 222/211; 222/530; 222/538; 215/274

[58] Field of Search ..... 222/530, 538, 222/211, 527, 529; 215/274

[56] References Cited

U.S. PATENT DOCUMENTS

| | | | |
|---|---|---|---|
| D. 200,364 | 2/1965 | Brody | D58/26 |
| 2,805,001 | 9/1957 | Biederman | 222/211 |
| 3,066,834 | 12/1962 | Kingsbury | 222/215 |
| 3,100,068 | 8/1963 | Kersten | 222/207 |
| 3,127,064 | 3/1964 | Fairchild | 222/153 |
| 3,181,745 | 5/1965 | Grobowski | 222/539 |
| 3,291,331 | 12/1966 | Grisham et al. | 215/1 |
| 3,482,739 | 12/1969 | Laas | 222/182 |
| 4,461,406 | 7/1984 | Vannucci | 222/211 |
| 4,462,544 | 7/1984 | Rutzel et al. | 239/33 |
| 4,726,491 | 2/1988 | Moon | 222/1 |
| 4,781,573 | 11/1988 | Depreter | 425/577 |
| 4,911,315 | 3/1990 | Shrum | 215/229 |
| 4,925,128 | 5/1990 | Brody | 222/211 |
| 5,048,705 | 9/1991 | Lynd et al. | 215/1 A |
| 5,388,712 | 2/1995 | Brody | 215/229 |
| 5,893,491 | 4/1999 | Brody | 222/530 |

*Primary Examiner*—Kevin Shaver
*Assistant Examiner*—Melvin A. Cartagena
*Attorney, Agent, or Firm*—Klein & Szekeres, LLP

[57] ABSTRACT

A lockable closure assembly is configured for an extensible spout container, of the type having a top with an elongate hollow extension extending distally from its surface and an extensible dispensing tube movable within the extension between a retracted position and an extended position, the tube having a distal end with an orifice for the dispensing of a liquid from the container. The closure assembly includes a closure that is internally dimensioned to fit onto the distal end of the tube so as to close the orifice, and a closure retainer element that is configured to seat against a portion of the closure when the closure is installed on the distal end of the tube, and that is internally dimensioned to frictionally engage the extension when the tube is in its retracted position while also engaging the closure. In a preferred embodiment, the closure has an open proximal end surrounded by a peripheral flange, and the closure retainer element is a hollow tubular sleeve having open proximal and distal ends. The sleeve is internally dimensioned to allow the passage of the closure therethrough when the sleeve is passed over the closure. The distal end of the sleeve terminates in an inwardly-directed annular rim that seats against the flange when the sleeve is passed over the closure to engage the extension. The engagement of the sleeve with the extension, and the seating of the annular rim of the sleeve against the flange of the closure, removably lock the closure onto the extension.

6 Claims, 2 Drawing Sheets

SQUEEZE BOTTLE WITH LOCKABLE CLOSURE ASSEMBLY

CROSS-REFERENCE TO RELATED APPLICATION

Not Applicable

FEDERALLY-SPONSORED RESEARCH OR DEVELOPMENT

Not Applicable

BACKGROUND OF THE INVENTION

This invention relates generally to the field of dispensers for liquids, of the kind generally categorized as "squeeze bottles". More particularly, this invention relates to the combination of a closure and a closure retainer for an extensible-spout squeeze bottle.

Squeeze bottles are very well known and come in a wide variety of configurations for a great many different applications. One particular type of squeeze bottle has become quite popular for dispensing lubricating oils and the like. This type of squeeze bottle has an elongated, hollow cap that accommodates a long, hollow, flexible tube that is normally retained within the bottle with just its outermost end portion extending from the opening at the tip of the cap. When it is desired to dispense the contents of the bottle, the tube is extended through the cap to form an elongate, flexible spout, thereby allowing the contents to be dispensed into small orifices and other relatively inaccessible places. Examples of such extensible-spout squeeze bottles are disclosed in U.S. Pat. Nos. 4,925,128 and 5,388,712, and U.S. Design Patent No. Des. 200,364.

Typically, such extensible-spout squeeze bottles are provided with a small, removable closure (e.g., a cap or stopper) for the opening at the distal end of the dispensing tube that forms the extensible spout. These spout closures can be removed accidentally, allowing the contamination of the bottle's contents, or the accidental leakage or spilling of the contents. Also, if the closure is removed by a small child, there is the possibility of accidental ingestion of the contents, especially since the spout may resemble a straw to a child. To avoid such situations, it would be advantageous to provide some means for retaining the closure firmly on the spout, so that it is not easily dislodged accidentally or removed by a small child.

While there are many ways to achieve the aforementioned goal, it is desirable to do so without adding significantly to the cost or complexity of the manufacturing process for the squeeze bottle. Thus, it would be advantageous to avoid any significant modification of the existing structure of the squeeze bottle or its closure in providing such a closure retainer. Furthermore, the retainer must not detract from either the principal functions or the overall utility of the bottle. For example, the inclusion of a closure retainer must not compromise the fluid-tight seal between the closure and the dispensing tube.

SUMMARY OF THE INVENTION

Broadly, the present invention is combination of a sealing closure for an extensible dispensing tube and a retainer that firmly seats, or removably locks, the closure against the top of an extensible-spout squeeze bottle, of the type having a dispensing orifice at the distal end of the extensible dispensing tube that forms the extensible spout. Viewed another way, the present invention is an improved extensible-spout squeeze bottle, of the type having a dispensing orifice at the distal end of the extensible dispensing tube that forms the extensible spout, wherein the improvement comprises a lockable closure assembly for the dispensing orifice. In a specific preferred embodiment, the squeeze bottle includes a top having an elongate tubular extension terminating in an orifice through which the dispensing tube extends. The lockable closure assembly in this preferred embodiment comprises a closure having an inside diameter dimensioned to removably fit onto the distal end of the dispensing tube so as to frictionally engage the exterior surface of the dispensing tube, and a removable retainer sleeve having an inside diameter dimensioned to slip over the closure and to frictionally engage the exterior surface of the elongate bottle top extension. The proximal end of the closure terminates in a peripheral flange, and the distal end of the sleeve terminates in an inwardly-directed annular lip or rim.

In use, the dispensing tube is slidable axially through the bottle top extension and its orifice between a retracted position and an extended position. In the retracted position, a short length of the dispensing tube extends distally out of the extension orifice. The closure may be placed on the dispensing tube so as to seal the dispensing orifice when the tube is in either position. When the closure is in place, and when the dispensing tube is in the retracted position, the sleeve is slipped over the closure and over the bottle top extension until the annular lip of the sleeve seats against the peripheral flange of the closure. When so installed, the sleeve frictionally engages the bottle top extension and locks the closure against the distal end of the extension. The engagement of the sleeve with both the extension and the closure retains the closure in place against accidental dislodgement. Furthermore, the sleeve must be removed before the closure, and the dexterity required to remove the sleeve discourages its removal by small children.

DETAILED DESCRIPTION OF THE PREFERRED EMBODIMENT

Figure 1:
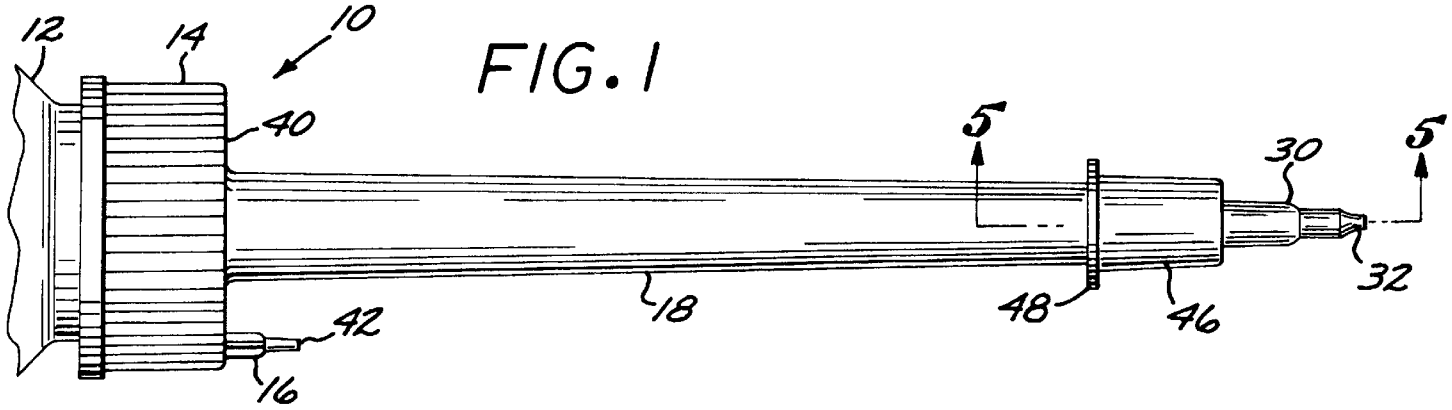
FIG. 1 is an elevational view of a squeeze bottle having a top with an integral tubular extension and an extensible dispensing tube, with a lockable closure assembly, in accordance with a preferred embodiment of the present invention, installed on the extension and the dispensing tube.

Referring now to the drawings, an extensible-spout squeeze bottle assembly 10 is shown, comprising a squeeze bottle 12 (only the top portion thereof being illustrated) and a screw-on top 14. The screw-on top 14, in accordance with a preferred embodiment of the present invention, includes an integral plug 16, as described briefly below, and as described in detail in U.S. Pat. No. 5,388,712, the disclosure of which is incorporated herein by reference. Other than the plug 16, the bottle top 14 may be made in accordance with the structure and method disclosed in U.S. Pat. No. 4,925,128, the disclosure of which is incorporated herein by reference. The top 14 includes a proximal end that is internally-threaded so as to screw onto an externally-threaded neck of the bottle 12. Extending distally from the top 14 is an elongate, hollow extension 18, terminating in a rounded distal tip 20 with a central orifice 22.

Figure 3:
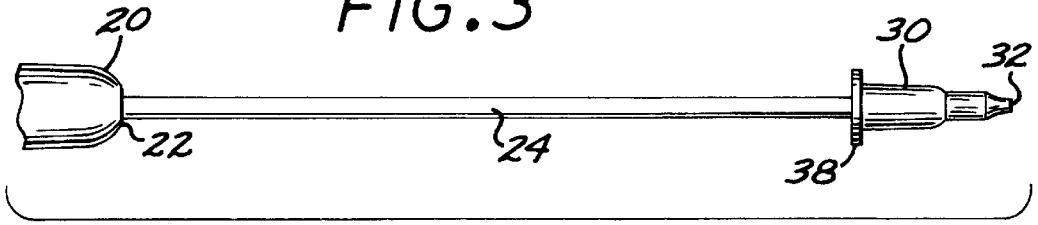
FIG. 3 is an elevational, view similar to that of FIG. 2, but showing the dispensing tube in its extended position.
Figure 4:
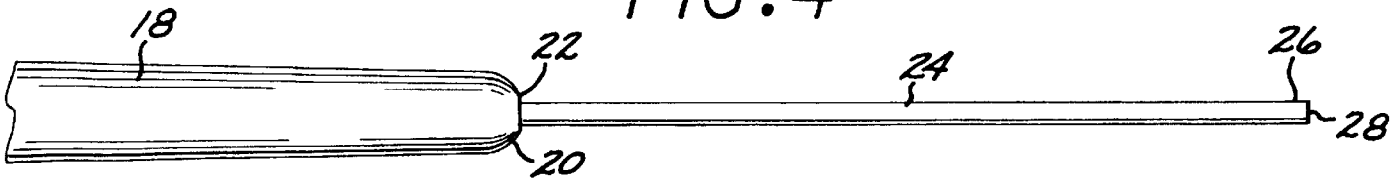
FIG. 4 is an elevational view, similar to that of FIG. 3, but with the closure having been removed.

An elongate, extensible dispensing tube 24 has an inner or proximal end (not shown) disposed within the bottle 12, and an outer or distal end 26 that extends out of the orifice 22 in the extension tip 20. The dispensing tube 18 slidably disposed within the bottle top extension 18 so as to be movable between a retracted position and an extended position. When the tube 24 is in the retracted position shown in FIG. 1, its proximal end lies near the bottom of the bottle 12, while its distal end 26 extends distally through the orifice 22. When it is desired to dispense the contents of the bottle 12, the distal end 26 of the tube 24 is pulled outwardly (distally) from the orifice 22 to a desired extended position, shown in FIGS. 3 and 4. A flange (not shown) is advantageously formed on the proximal end of the tube 24 to provide a stop against the interior of the top 14, so that the tube 24 cannot be easily removed from the bottle 12.

The distal end 26 of the dispensing tube 24 has a dispensing orifice 28 through which the bottle's contents are dispensed. The dispensing orifice 28 is covered or closed, when not in use, by a removable cap-like closure 30, having a closed distal end 32 and an open proximal end 34, opening into a hollow interior 36, which is dimensioned to receive the distal end 26 of the dispensing tube 24 with a friction fit, so as to close or cover the dispensing orifice 28. The proximal end 34 of the closure 30, which terminates in a peripheral flange 38, seats against the distal tip 20 of the bottle top extension 18 when the dispensing tube 24 is in its retracted position, as shown in FIG. 2.

The top 14 has an annular outer surface 40 coaxially surrounding the base of the hollow extension 18. If the plug 16 is provided, it extends distally from the annular surface 40, and it has an axially-fluted configuration. The plug 16 may also include an integral, rod-like extension or stopper 42, the purpose of which will be described below. The total length of the plug 16 and the stopper 42 is advantageously somewhat less than the axial dimension of the interior 36 of the closure 30. The exterior of the plug 16 is dimensioned so that the closure 30 can be installed on the plug 16, the latter being frictionally received in the interior 36 of the closure 30. The fit between the closure 30 and the plug 16 should be tight enough so that the closure 30 is retained on the plug 16 when the bottle assembly 10 is inverted, or when it is subjected to the jostling that may normally be expected during use.

If the original closure 30 is lost or damaged, the stopper extension 42 provides an alternative or secondary stopper or closure for the dispensing tube orifice 28. The dispensing tube 24 is simply extended until its distal end 26 is brought into the proximity of the plug 16 and the stopper extension 42, and the stopper extension 42 is then inserted into the dispensing tube orifice 28. To provide a fluid-tight closure for the dispensing tube orifice 28, the outside diameter of the stopper extension 42 should be approximately the same as (or slightly larger than) the inside diameter of the dispensing tube orifice 28, so as to provide an interference fit within the orifice 28. The interior of the closure 30 includes a distal channel portion 44 that is dimensioned to receive the stopper extension 42 when the closure 30 is installed on the plug 16.

Figure 2:
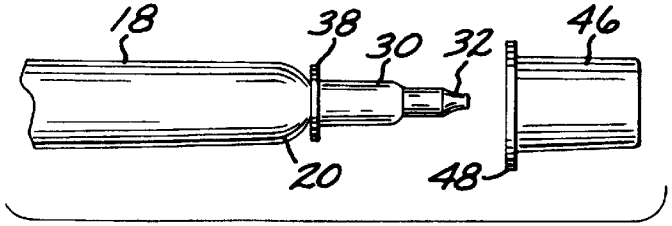
FIG. 2 is an elevational view of the bottle top extension and the closure, with the dispensing tube in its retracted position, and with the retainer sleeve of the closure assembly shown as removed.
Figure 5:
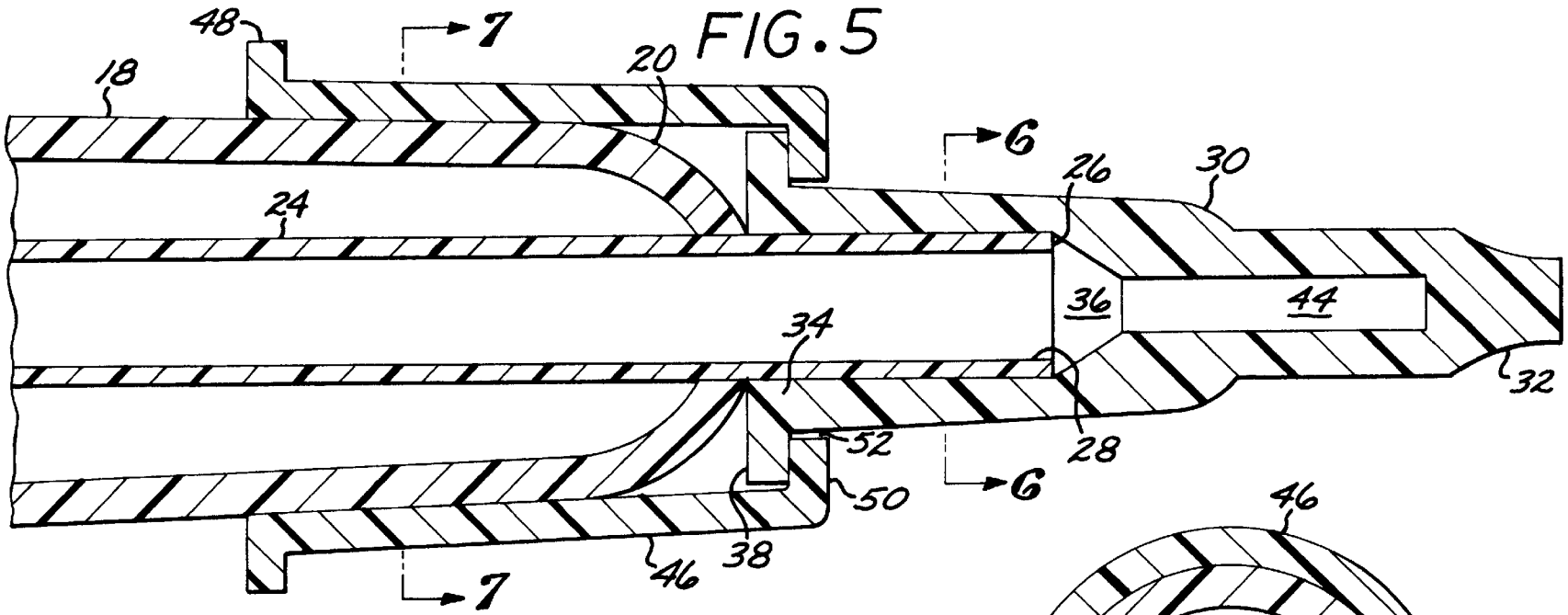
FIG. 5 is an axial cross-sectional view taken along line 5—5 of FIG. 1.
Figure 7:
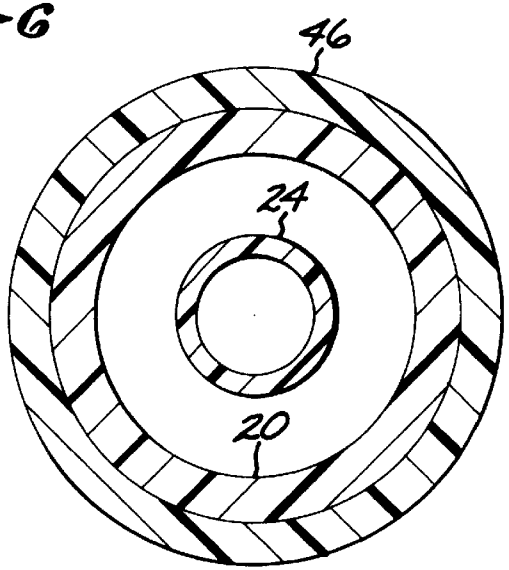
FIG. 7 is a radial cross-sectional view, taken along line 7—7 of FIG. 5.
Figure 6:
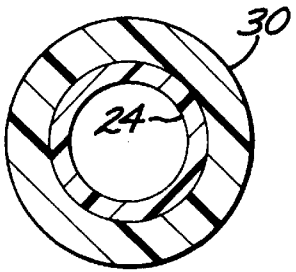
FIG. 6 is a radial cross-sectional view, taken along line 6—6 of FIG. 5.

As shown in FIGS. 1, 2 and 5, the closure 30 is provided as one component of a closure assembly, the other component of which is a closure retainer sleeve 46. The sleeve 46 is formed as a hollow tubular element, open at both ends. The proximal end of the sleeve is advantageously terminated by a peripheral flange 48 to facilitate grasping. As shown in FIG. 5, the distal end of the sleeve 46 terminates in an inwardly-directed annular lip or rim 50. The inside diameter of the retainer sleeve 46 is greater than the outside diameter of the peripheral flange 38 on the proximal end of the closure 30, but the internally-directed annular lip or rim 50 at the distal end of the retainer sleeve 46 defines an opening 52 having a diameter that is less than the outside diameter of the closure flange 38. The retainer sleeve 46 is thus internally dimensioned to allow the closure 30 to pass through the sleeve 46 as the sleeve 46 is slipped over the closure 30 until the internally-directed rim or lip 50 of the sleeve 46 abuts against the closure flange 38.

As best shown in FIGS. 1 and 5, the retainer sleeve 46 fits over the closure 30 when the closure 30 is seated on the distal end of the dispensing tube 24, and when the dispensing tube 24 is in its retracted position. When thus installed, the retainer sleeve 46 frictionally engages the exterior surface of the distal tip 20 of the bottle top extension 18. Furthermore, as shown in FIG. 5, the annular lip or rim 50 at the distal end of the sleeve 46 seats against the peripheral flange 38 at the proximal end of the closure 30, removably locking the closure 30 in place against the distal tip 20 of the bottle top extension 18. This locking action also secures the dispensing tube 24 in its retracted position. Thus, in order to remove the closure 30 or to extend the dispensing tube 24 to its extended position, the retainer sleeve 46 must first be removed by grasping its peripheral flange 48 and pulling it distally over the closure 30. The dexterity required for this maneuver is beyond that of the typical small child, thereby substantially reducing the risk of accidental misuse of the bottle by small children. Moreover, the risk of accidental spillage as a result of inadvertent closure removal when the bottle is carried or jostled is also reduced.

From the foregoing description, it can be seen that the present invention provides an effective solution to the problem of inadvertent closure removal, without adding appreciably to the overall cost of the bottle assembly, and without significantly compromising or impairing any of the other structural or functional characteristics of the squeeze bottle.

While a preferred embodiment of the invention has been described herein, it is understood that a number of variations and modifications may suggest themselves to those skilled in the pertinent arts. For example, the configurations of the retainer sleeve 46 and the closure 30 may be varied to accommodate a variety of bottle top and dispensing tube configurations. The invention may also be embodied in a top that attaches to a bottle by means other than threads, and the bottle does not necessarily have to be a squeeze bottle. These and other modifications that may suggest themselves are considered within the spirit and scope of the present invention as defined in the claims that follow.

What is claimed is:

1. An improved extensible spout container, of the type having a top with an elongate hollow extension extending distally from its surface and an extensible dispensing tube movable within the extension between a retracted position and an extended position, the tube having a distal end with an orifice for the dispensing of a liquid from the container, wherein the improvement comprises:

a closure having an open proximal end surrounded by a peripheral flange, the closure being internally dimensioned to fit onto the distal end of the tube so as to close the orifice; and a closure retainer element that is configured to seat against a portion of the closure when the closure is installed on the distal end of the tube, and that is internally dimensioned to frictionally engage the extension when the tube is in its retracted position while also engaging the closure, wherein the closure retainer element comprises a hollow tubular sleeve having open proximal and distal ends, and the sleeve being internally dimensioned to allow the passage of the closure therethrough when the sleeve is passed over the closure, the distal end of the sleeve terminating in an inwardly-directed annular rim that seats against the peripheral flange when the sleeve is passed over the closure to engage the extension.

2. The improvement of claim 1, wherein the engagement of the sleeve with the extension and the seating of the annular rim of the retainer sleeve against the peripheral rim of the closure removably lock the closure onto the extension.

3. The improvement of claim 1, wherein the sleeve has a peripheral flange around its distal end.

4. A lockable closure assembly for an extensible spout container, of the type having a top with an elongate hollow extension extending distally from its surface and an extensible dispensing tube movable within the extension between a retracted position and an extended position, the tube having a distal end with an orifice for the dispensing of a liquid from the container, the closure assembly comprising:

a closure having an open proximal end surrounded by a peripheral flange, the closure being internally dimensioned to fit onto the distal end of the tube so as to close the orifice; and a closure retainer element that is configured to seat against a portion of the closure when the closure is installed on the distal end of the tube, and that is internally dimensioned to frictionally engage the extension when the tube is in its retracted position while also engaging the closure, wherein the closure retainer element comprises a hollow tubular sleeve having open proximal and distal ends, and the sleeve being internally dimensioned to allow the passage of the closure therethrough when the sleeve is passed over the closure, the distal end of the sleeve terminating in an inwardly-directed annular rim that seats against the peripheral flange when the sleeve is passed over the closure to engage the extension.

5. The closure assembly of claim 4, wherein the engagement of the sleeve with the extension and the seating of the annular rim of the retainer sleeve against the peripheral rim of the closure removably lock the closure onto the extension.

6. The closure assembly of claim 4, wherein the sleeve has a peripheral flange around its distal end.

* * * * *